United States Patent [19]

Chatani

[11] 4,246,718

[45] Jan. 27, 1981

[54] INTERCONNECTING TOY BLOCK ARRANGEMENT

[75] Inventor: Yasushi Chatani, Tokorozawa, Japan

[73] Assignee: Kawada Co., Ltd., Japan

[21] Appl. No.: 64,521

[22] Filed: Aug. 7, 1979

[30] Foreign Application Priority Data

Sep. 3, 1979 [JP] Japan ..... 54-29212[U]

[51] Int. Cl.[3] ..... A63H 33/08

[52] U.S. Cl. ..... 46/25; 46/26

[58] Field of Search ..... 46/25, 26, 28, 29, 30, 46/31

[56] References Cited

U.S. PATENT DOCUMENTS

| | | | |
|---|---|---|---|
| 2,975,547 | 3/1961 | Greve | 46/17 X |
| 3,604,130 | 9/1971 | Forrstrom | 46/25 X |
| 3,611,621 | 10/1971 | Folson | 46/25 |
| 3,996,692 | 12/1976 | Daenen | 46/17 |
| 4,106,657 | 8/1978 | Dogliotti | 46/23 |

*Primary Examiner*—F. Barry Shay

*Attorney, Agent, or Firm*—Don B. Finkelstein

[57] ABSTRACT

An improved frictional interconnecting toy block arrangement having a body means with walls defining a body cavity. The interconnection of toy blocks with each other is achieved by a female coupler means extending through the cavity of the body means of the toy block and having an aperture adapted to receive a male coupler means. Male coupler means which extends outwardly from a wall of the toy block is insertable into the aperture of the female coupler means for frictional retention therein. The male coupler means are generally fabricated as part of the body means of the block. The body means of the block is fabricated of two separate body members coupled together along a median plane. Coupling means are provided on the two body members to retain the two body members together. Provision of the body means comprised of the two separate body members allows each body member to be fabricated to provide a different appearance such as, for example, different color, different surface texture, or the like, thereby enhancing the play value of the toy block arrangement.

22 Claims, 12 Drawing Figures

FIG. 3
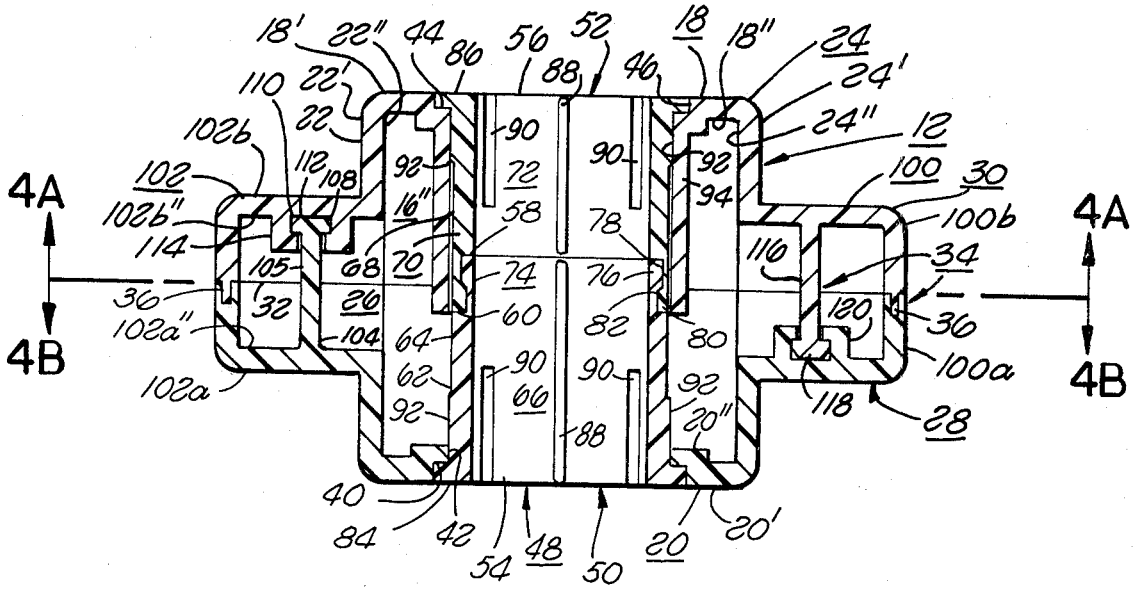
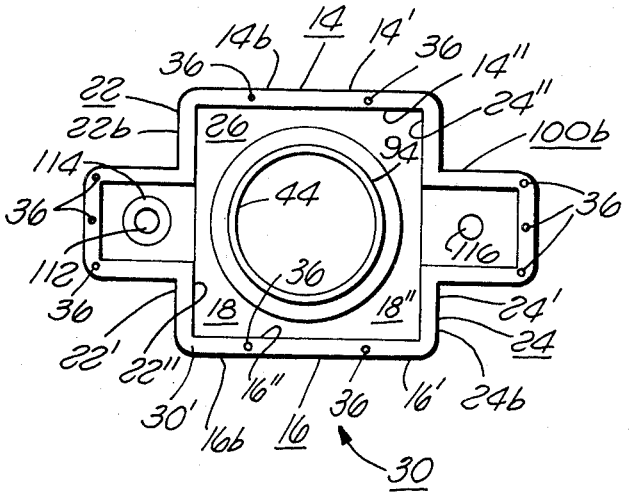
FIG. 4A
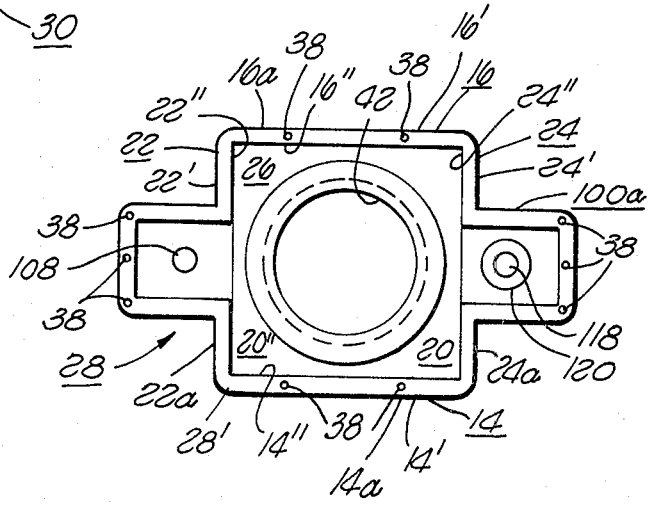
FIG. 4B

INTERCONNECTING TOY BLOCK ARRANGEMENT

BACKGROUND OF THE INVENTION

1. Field of the Invention

This invention relates to toy blocks, and, more particularly, to hollow toy blocks having frictional interconnection arrangements for detachable interconnection of a plurality of individual toy blocks.

2. Description of the Prior Art

Toy blocks have long been fabricated from many different materials. Wood, ceramics, metals, and plastics have all been utilized heretofore. Various different interlocking or interconnecting arrangements have also been utilized to permit the blocks to be interconnected with each other and removed from each other. Such interconnection arrangements have heretofore included tongue-in-groove interconnections, notches and matching male members of various types, pin and slot arrangements, and various kinds and shapes of protrusions and protrusion accepting apertures.

Toy blocks, in general, are designed for children, to entertain, educate and aid in the development of improved physical dexterity. Many of the above different interconnection combinations are specifically designed to appeal to children having particular age and mental development levels. That is, difficult interconnection combinations generally appeal to older and more educationally developed children, and/or to children having a comparatively high degree of physical dexterity. However, simpler interconnecting arrangements are required for younger children, since, in the case of younger children, it is very important to provide toys which challenge the child, but do not frustrate the child to the point that the child rejects the toys. The small fingers, lack of physical strength, and limited manual dexterity of younger children impose constraints on the design and fabrication of interconnecting toy blocks. Such toy blocks, for such younger children, must, therefore, be comparatively easy to connect together and disconnect. Such ease of interconnection and removal enhances the play value of the blocks. Further, it is also required that such blocks, when interconnected, are able to withstand the rigors and stresses normally associated with the use of the blocks without inadvertent disconnection.

Additionally, the blocks should also be able to provide a level of complexity and sophistication during play, sufficient to maintain the interest of older children or even adults, in order to extend the play life and utility thereof. Such blocks should also be visually attractive in order to further enhance their play value. The above, often conflicting, requirements, have not, heretofore, been achieved in interconnecting toy block arrangements.

Particularly, in molded plastic toy blocks, the body means of the toy blocks has heretofore been generally unitarily fabricated. As such, the entire body means of the toy blocks was fabricated of the same material, having the same surface texture, and the same molded in color. It has been found that enhanced play value can be achieved by providing the body means of the toy blocks having different colors on different portions thereof. This tends to increase the attractiveness of blocks as a playtime object and, further, provides for a greater variety of visual appearances in the structures created by the interconnection of a plurality of such blocks. In order to achieve such difference in color in a single toy block of an interconnecting toy block arrangement, it has heretofore been necessary to attempt to provide different colors on different portions by use of paint or other surface colorations. Such steps are, of course, comparatively expensive. Preferably, a plurality of colors is provided in the fabrication of the toy block itself, so the extra step of applying the surface coloration becomes unnecessary.

SUMMARY OF THE INVENTION

Accordingly, it is an object of the present invention to provide an improved interconnecting toy block arrangement.

It is another object of the present invention to provide a comparatively inexpensively fabricated toy block arrangement.

It is another object of the present invention to provide interconnecting toy blocks wherein each of the toy blocks has a body means fabricated of two separate body members, each of which may be differently colored.

It is another object of the present invention to provide interconnecting toy blocks which may be comparatively easily connected together and disconnected by the small fingers of young children and yet resistant to inadvertent disconnection.

It is another object of the present invention to provide an interconnecting toy block arrangement which, through its utilization, improves the manual dexterity of the user, It is yet another object of the present invention to provide an improved toy block arrangement which is visually attractive and still provides a high level of play value and is comparatively inexpensive to fabricate.

The above, and other objects of the present invention are realized in a preferred embodiment, by providing a semi-rigid body means having a plurality of wall members, and each of the wall members having inner surfaces and outer surfaces. The inner surfaces of the plurality of wall members define a body cavity. The body means is further comprised of a first body member which is comprised of a first group of the plurality of wall members, and a second body member which is comprised of a second group of the plurality of wall members. Coupling means are provided on the first body member and second body member, for coupling the first body member to the second body member along a median plane. The first body member and second body member may, for example, be injection molded plastic and, during the injection molding fabrication thereof, may have coloration provided so that the first body member has a different color than the second body member. Alternatively, or in addition, a surface texture or other characteristic of the first body member may vary from that correspond ng characteristic of the second body member.

First internal walls are provided on a first wall of the first group of the plurality of wall members of the first body member to define an aperture therethrough and second internal walls defining a second aperture are provided in a second wall of the second group of the plurality of wall members of the second body member and the second aperture is aligned with the first aperture.

A female interblock coupler means, which may be comprised of a first female coupler member and second female coupler member, is provided extending through the body means and through the body cavity, and is positioned in the first and second apertures of the body means.

Each of the first and second female coupler members comprising the female interblock coupler means, has an outer end adjacent the wall of the body means and an inner end contained within the body cavity of the body means. Interconnection means are provided on the inner ends of the first and second female coupler members for coupling the first and second female coupler members together. The female coupler members each have walls extending from the outer end to the inner end, defining a male coupler receiving aperture. Retention means are also provided on the outer ends of the first and second female coupler members for retaining the outer ends substantially co-planar with the external surface of the wall of the body means.

In a set of interconnecting toy blocks fabricated in accordance with the principle of the present invention, there is also provided, on at least some of the blocks, one or more male interblock coupler means, extending outwardly from the face of the block. The male coupler means, in preferred embodiments of the present invention, are also divided along the median plane. The male coupler means are sized and configured to fit within the aperture of the female coupler means and to be frictionally retained therein. In preferred embodiments of the present invention, there may be provided on the walls of the female coupler means defining the aperture therein, a plurality of ribs so that the ribs contact the male coupler means when the blocks are interconnected. In such embodiments, the friction, and therefore the force and dexterity required to interconnect and disassemble the toy blocks, one from another, is reduced without reducing the play value or interest thereof. Further, if desired, slots may be provided in the female coupling members adjacent their outer ends to allow a resilient expansion thereof when the male coupler means is inserted in the aperture of the female coupler means. Such slots further provide more precise control of the frictional force retaining the blocks in an interconnected condition.

BRIEF DESCRIPTION OF THE DRAWING

The above and other objects of the present invention may be more fully understood from the following detailed description taken together with the accompanying drawing, wherein similar reference characters refer to similar elements throughout, and in which:

FIG. 3 is a sectional view, taken along the line 3—3 of FIG. 2;

FIG. 4*a* is a view of one of the body members of the embodiment shown in FIG. 3, taken generally along the view line 4*a*—4*a* of FIG. 3;

FIG. 4*b* is a view of the other body member of the embodiment shown in FIG. 3, taken generally along the view line 4*b*—4*b* of FIG. 3;

DESCRIPTION OF THE PREFERRED EMBODIMENT

Figure 1:
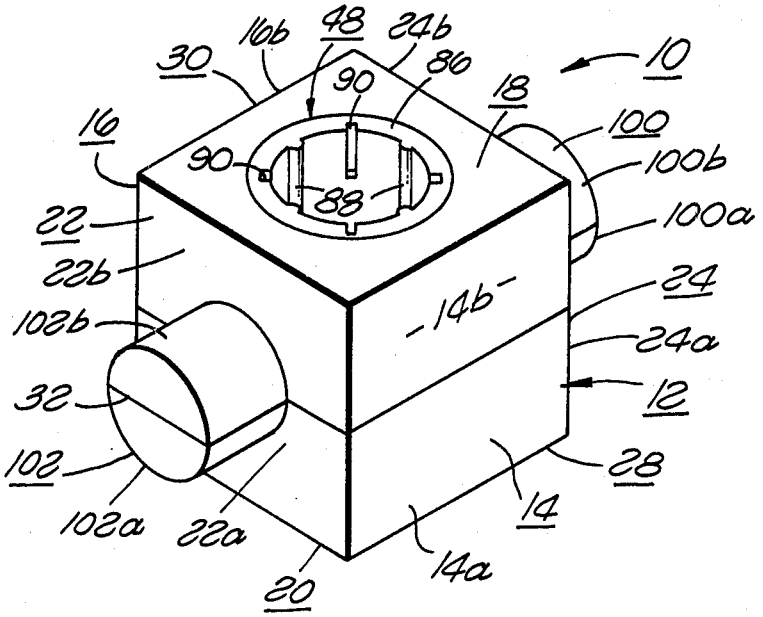
FIG. 1 is a perspective view of one embodiment of the present invention.

Referring now to FIGS. 1, 2, 3, 4A and 4B, there is illustrated one embodiment generally designated 10 of an interconnecting toy block arrangement, according to the principles of the present invention. In the embodiment 10 there is provided a semi-rigid body means generally designated 12, having a first predetermined flexibility and having a plurality of wall members 14, 16, 18, 20, 22, and 24. In the embodiment 10, the plurality of wall members 14, 16, 18, 20, 22, and 24 define substantially a cube. However, it will be appreciated that applicant's invention is not limited to blocks in which the body member is in the form of a cube. Rather, applicant's invention as hereinafter described, may be utilized with blocks having wall members defining different configurations such as rectangular parallepiped, or otherwise.

Each of the plurality of wall members 14, 16, 18, 20, 22, and 24, have corresponding external surfaces 14', 16', 18', 20', 22', and 24', and corresponding internal surfaces 12'', 16'', 18'', 20'', 22'', and 24'', and the internal surfaces define a body cavity generally designated 26.

The semi-rigid body means 12 is preferably fabricated from an injection molded plastic such as, for example, ABS or the like, and has a predetermined flexibility. The body means 12 is fabricated of a first body member 28 and a second body member 30, coupled together along a median plane designated 32. Thus the median plane 32 divides each of the wall members 14, 16, 22 and 24, into two groups. Body member 28 thus has a first group of the plurality of wall members indicated at 14*a*, 16*a*, 22*a*, 24*a*, and 20. Second body member 30 is thus comprised of second group of the plurality of wall members 14*b*, 16*b*, 22*b*, 24*b* and 18. The first body member 28 is coupled to second body member 30 along the median plane 32, and first body member 28 has peripheral edge surfaces 28' and second body member 30 has peripheral edge surfaces 30' along the median plane and first body member 28 is coupled to second body member 30 on the peripheral edges 28' and 30', respectively. In order to provide this coupling, coupling means, generally designated 34, is provided on the first body member 28 and second body member 30 to couple the first body member 28 to the second body member 30 along the median plane 32. The coupling means 34 generally comprises a plurality of male coupling members 36 on peripheral edge 30' of second body member 30 and extending outwardly therefrom. The first body member 28 is provided with a plurality of male body coupling member receiving cavities 38 in the peripheral edge 28' aligned to receive a plurality of male body coupling members 36. In embodiment 10, the male body coupling members 36 are frictionally retained in the male body coupling member receiving cavities 38 to retain first body member 28 coupled to second body member 30. In preferred embodiments of the present invention, the first body member 28 and second body member 30 are adapted to be coupled together by the above mentioned frictional engagement during the normal play activities. However, it will be appreciated that in other embodiments of the present invention, the first body member 28 may be selectively removed from the second body member 30 in order that they may be combined with the corresponding second body member and first body member of other blocks.

In order to increase the play value of the blocks according to the principles of the present invention, first body member 28 is preferably colored a different color from second body member 30. Thus, when the blocks are fabricated as mentioned above from injection molded plastic, such coloring may be applied during the molding process and thus there is provided a body means 12 in which half of the body means such as first body member 28 is of one color and second body member 30 is of a different color. Additionally, or alternatively, it will be appreciated that different surface textures may be provided on the two body members 28 and 30, in order to further increase their attractiveness and enhance their play value. As noted above, in prior art plastic blocks, different colors on any one block could generally only be provided by surface coating, such as by painting or the like, which is comparatively time consuming and expensive and thus the blocks, according to the principles of the present invention, may be much more economically fabricated than blocks heretofore available.

In the embodiment 10, the male coupling members 36 are shown on body member 30 and the male body coupling member receiving cavities are shown on body member 28. It will be appreciated that in other embodiments of the present invention, male body coupling members may be provided on both body members with appropriately aligned male body coupling member receiving cavities on the other body member.

Wall 20 of first body member 28 of body means 12 is provided with first internal walls 40 defining a first aperture 42 therethrough. Wall 18 of second body member 30 has second walls 44 defining a second aperture 46 therethrough. First aperture 42 and second aperture 46 are aligned when first body member 28 and second body member 30 are coupled together as illustrated in FIG. 3.

A first semi-rigid female interblock coupler means, generally designated 48 is positioned in first aperture 42 and second aperture 46 for retention therein. The female interblock coupler means 48 is also semi-rigid and, preferably, is fabricated from an injection molded plastic such as ABS or the like. First female interblock coupler means 48 is comprised of the first female coupler member 50 which is positioned in aperture 42 and a second female coupler member 52 which is positioned in aperture 46. First female coupler member 50 and second female coupler member 52 are substantially identical and have outer ends 54 and 56, respectively, and inner ends 58 and 60, respectively, which are spaced a preselected distance from the respective outer ends and are positioned within the body cavity 26 of the body means 12. First female coupler member 50 is also provided with walls 62 extending between the outer end 50 and inner end 58 and walls 62 have external surfaces 64 and internal surfaces 66. The internal surfaces 66 define a male coupler means receiving aperture extending from the outer end 50 toward the inner end 58. Similarly, second female coupler member 52 has walls 68 having external surfaces 70 and internal surfaces 72 and internal surfaces 72 define a male coupler means receiving aperture extending from the outer end 56 to the inner end 60.

The inner ends 58 and 60 of first female couple member 50 and second female coupler member 52, respectively, are provided with interconnection means generally designated 74, for coupling the first female coupler means 50 to the second female coupler means 52 within the cavity 26 of body member 12. The interconnection means comprises a ring or shoulder 76 on the first female coupler member 50, engageable with a groove 78 on second female coupler member 52. Similarly, second female coupler member 52 has a ring or shoulder 80 engageable with a groove 82 on first female coupler member 50. Thus, the first female coupler member 50 is not completely identical to the second female coupler member 52 and differs in configuration as described above to provide the interconnection means 74.

Retention means, generally designated 84 is provided on the outer end 54 of first female coupler member 50 for retaining first female coupler member 50 in aperture 42. Similarly, retention means 86 is provided on outer end 56 of second female coupler member 52 to retain second female coupler member 52 in second aperture 46. As shown, the retention means 84 and 86 comprise generally flange-like members.

Figure 2:
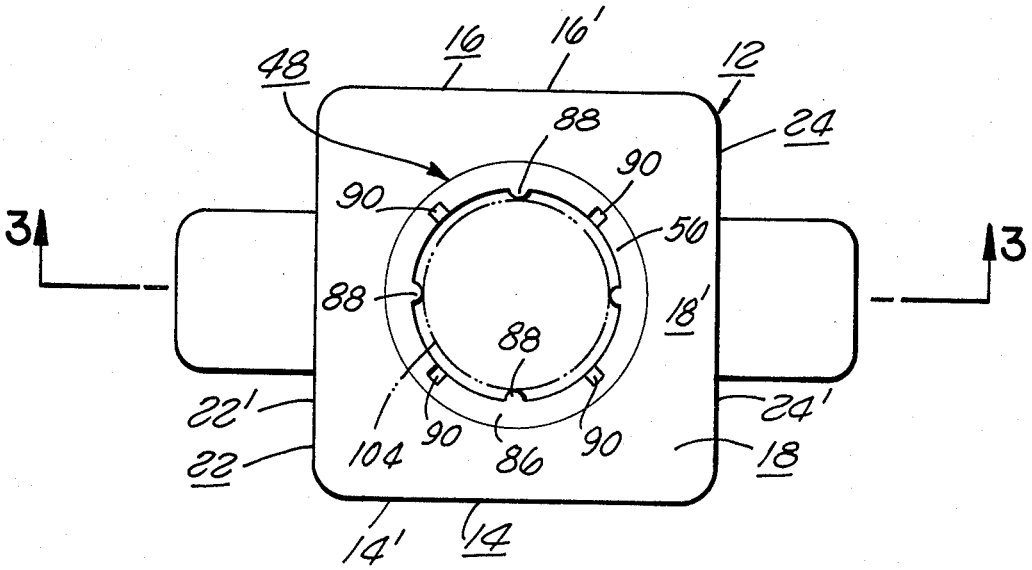
FIG. 2 is a plan view of the embodiment of the invention shown in FIG. 1.

In some embodiments of the present invention, it may be desirable to provide a plurality of internal ridges 88 on the internal surfaces 66 and 72 of the first female coupler member 50 and second female coupler member 52 for purposes hereinafter set forth. Additionally, in some embodiments of the present invention, there may be provided slots 90 in first female coupler member 50 and second female coupler member 52, extending from the outer ends 54 and 56, respectively, toward the inner ends 58 and 60, respectively. The slots may, if desired, as shown in FIG. 2, also extend into the retention means 84 and 86. The slots 90 are provided for purposes hereinafter set forth.

There may also be provided ridges on external surfaces 62 and 70 of first female coupler member 50 and second female coupler member 52 extending from the respective outer ends a predetermined distance toward the respective inner ends. The ridges 92 on the external surfaces 64 and 70 of walls 62 and 68, respectively, extend from the respective outer ends 54 and 56, a predetermined distance toward the inner ends 58 and 60, respectively. The ridges 92 on the first female coupler member 50 engage the walls 40, defining the first aperture 42, and the ridges 92 on the second female coupler member 52 engage the walls 44, defining the second aperture 46, for frictional retention of the female coupler means 48 in the body member 12.

As shown most clearly in FIG. 3, the internal walls 44 of the wall 18 are provided with a skirt means 94 extending a predetermined distance into the cavity 26 of the body means 12. In the embodiment 10, as illustrated in FIG. 3, a skirt means 94 extends beyond the median plane 32. The ridges 92 on second female coupler member 52 engage only the portion of the skirt 94 adjacent the wall 18, as illustrated, and thus there is a gap between the skirt 94 and the outer surface 70 of wall 68 of second female coupler member 52 in the body cavity 26.

The wall member 24 of body means 12 is provided, in the embodiment 10, with a first male interblock coupler means 100, extending outwardly therefrom a predetermined distance. Preferably, the first male interblock coupler means 100 extends a distance less than the distance from the outer surface 18' to the median plane 32. The first male interblock coupler means is configured to match the aperture in the female coupler means defined by the internal walls 66 and 72 of female coupler members 50 and 52. This provides a frictional and detachable retention of the male interblock coupler means 100 in a female coupler means 48 of another block so that the blocks may be frictionally detachably interconnected with each other. In the particular block embodiment 10, there is also provided a second male interblock coupler means 102, extending outwardly a predetermined distance from the wall 22. Second male interblock coupler means 102 is substantially identical to the first male interblock coupler means 100. Each of the first male interblock coupler means 100 and second male interblock coupler means 102 are divided by the median plane 32 into a first portion **100*b* and 102*b* on the body member 30 of body means 12 and 100*a* and 102*a*, respectively, on the body member 28 of body means 12**.

In those embodiments of the present invention wherein the ridges 88 are provided on the internal surfaces 66 and 72 of the female coupler means 48, it is preferred that the male interblock coupler means such as first male interblock coupler means 100 and second male interblock coupler means 102 be dimensioned so the external surfaces thereof contact the ridges 88 as indicated by phantom line 104 on FIG. 2. Such a dimensional configuration provides a more precise control of the frictional forces necessary for interconnecting one block according to the principles of the present invention with another block according to the principles of the present invention and the removal thereof. In those embodiments wherein the ridges 88 are not provided, the external surfaces of the male interblock coupler means 100 and 102 contact the internal surfaces 66 and 72 of the female coupler means 48 of another block.

In those embodiments of the present invention wherein the slots 90 are provided, resilient deformation of the female coupler member 50 and 52 may occur when a male interblock coupler means such as male interblock coupler means 100 and 102 are inserted therein. The resilient deformation further provides a more precise control of the forces associated with retention of one block according to the principles of the present invention, when interconnected with another block according to the principles of the present invention.

In order to aid in the coupling of first body member 28 with second body member 30, the internal surface **102*a*'' of male member 102*a* of second male coupler means 102 is provided with a headed male member 104 extending into the cavity 26 of body means 12, and comprised of a shaft portion 106 and a headed portion 108. Aligned with a first headed male member 104, are walls 110, defining an aperture 112 in a boss 114 on internal surfaces 102*b*'' of second male member 102*b* of second male interblock coupling means 102, for receiving the headed portion 108 of headed male member 104. Similarly, a second headed male member 116, substantially identical to first headed male member 104, is provided on second male member 100*a* of first male interblock coupling means 100 and an aperture 118 is provided in a boss 120 of first male member 100*a* of first male interblock coupling means 100. The first headed male member 104 and second headed male member 116 thus aid in the secure coupling of first body member 28 with second body member 30** to prevent inadvertent separation thereof during normal play activity involving the interconnection of one toy block according to the principles of the present invention with another toy block according to the principles of the present invention.

In FIG. **4*a* and in FIG. 4*b*, the female interblock coupler means 48, comprised of first female interblock coupling member 50 and second female interblock coupling member 52**, have been omitted for purposes of clarity.

Figure 5:
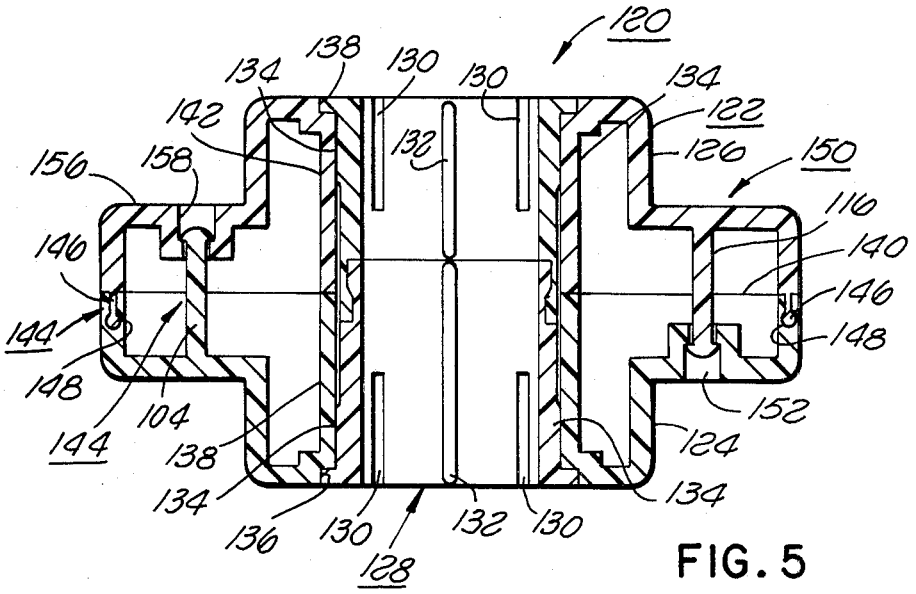
FIG. 5 illustrates another embodiment of the present invention.

FIG. 5 illustrates another embodiment, generally designated 120, of the present invention. FIG. 5 is a sectional view, generally similar to the sectional view shown in FIG. 3. In embodiment 120, there is provided a body means 122 comprised of a first body member 124, a second body member 126 coupled thereto. The first body member 122 is generally similar to the first body member 28 and the second body member 126 is generally similar to the second body member 30 of embodiment 10. A female coupler means 128, which is substantially identical to the female coupler means 48 described above, is provided in the body means 122, and, if desired, may be provided with slots 130, substantially the same as slots 90 described above, and internal ridges 132, substantially identical to internal ridges 88 described above, external ridges 134, generally similar to external ridges 92, described above, and retention means 136 and 138, generally similar to retention means 84 and 86, described above. However, in the embodiment 120, the first body member 124 is provided with the skirt portion 138, extending to the median plane 140 for abutment with the skirt portion 142, on the second body member 126, at the median plane 140. The abutment of the first skirt portion 138 and second skirt portion 142 provides additional rigidity to the body means 122 when the first body member 124 is coupled to the second body member 126 in the configuration as illustrated in FIG. 5. Coupling means generally designated 144 are provided for coupling first body member 124 to second body member 126. The coupling means 144 are generally similar to the coupling means 34 in embodiment 10, except that the plurality of male coupling members 146 are headed male members, fitting into appropriately configured apertures 148. In the coupling means 34, the male coupling members 36 were cylindrical. The headed male members 146 of the coupling means 144, in the embodiment 120, provide for more secure coupling of the first body member 124 to the second body member 126. Additionally, the coupling means 144 may also comprise first and second headed male member 104 and 116. Second headed male member 116 is coupled to the internal surface of first male interblock coupling means 150 and fits into an aperture 152. Similarly, first headed male member 104 is provided on the interior of second male interblock coupling means 156 and fits into an aperture 158. As shown in the embodiment 120 of FIG. 5, the apertures 152 and 158 extend through the walls of the first male interblock coupling means 150 and second male interblock coupling means 156, respectively.

Figure 6:
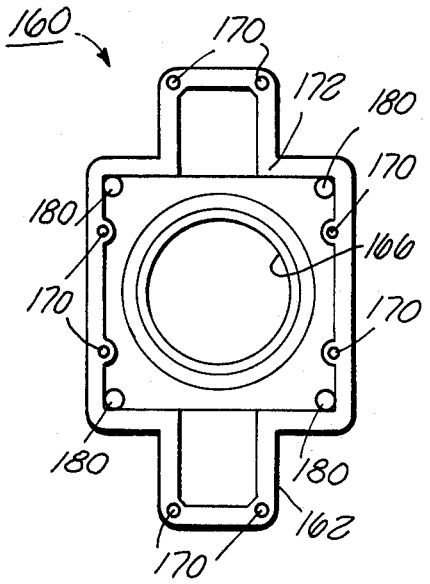
FIG. 6 is a view similar to the view shown in FIG. 4*a* of one of the body members of another embodiment of the present invention.
Figure 7:
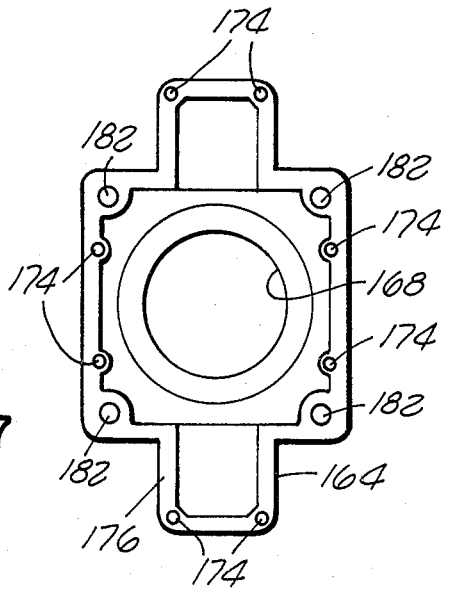
FIG. 7 is a view similar to the view shown in FIG. 4*b* of the other body member of the embodiment shown in FIG. 6.

FIGS. 6 and 7 illustrate another embodiment generally designated 160, according to the principles of the present invention. FIG. 6 illustrates a body member 162 and FIG. 7 illustrates a body member 164, which, when coupled together provide a body means in accordance with the principles of the present invention. In FIGS. 6 and 7, which are similar, respectively, to FIGS. 4*a* and 4*b* of embodiment 10, described above, the female interblock coupling means which is positionable in apertures 166 and 168, have been omitted for clarity. Embodiment 160 of FIGS. 6 and 7, illustrates an alternative arrangement for providing a coupling means between the first body member 162 and second body member 164. The coupling means may generally comprise a plurality of male body coupling members 170 located in the peripheral edges 172 of the body member 162. The plurality of male body coupling members 170 may be cylindrical, such as the male body coupling members 36 of the embodiment 10 described above, or they may be headed male members such as the headed male body coupling members 146 of the embodiment 120 shown in FIG. 5. Appropriately sized and configured male body coupling member receiving cavities 174 are provided in the edge 176 of second body member 164 in aligned position to receive the plurality of male body coupling members 170. Additionally, while the headed male members 104 and 116 described above were provided in the male interblock coupling means, in the embodiment 160 of FIGS. 6 and 7, a plurality of male coupling members 180, which, for example, may be headed male members similar to headed male members 104 and 116, are provided in the corners defined by the wall members of the first body member 162, adjacent the peripheral edges 172. A plurality of apertures 182 are provided in the peripheral edges 176 of the second body member 164 and are configured to receive the male members 180 to aid in the coupling of first body member 162 to second body member 164. The male coupling members 180 may be headed male members such as headed male members 104 or they may be cylindrical.

In the embodiments 10, 120 and 160 described above, there has been illustrated embodiments of the present invention in which two male interblock coupling means are provided extending outwardly from oppositely disposed walls of the body means. It will be appreciated that other arrangements and configurations of male interblock coupling means may be provided, as well as other variations in the configuration and number of female interblock coupling means.

Figure 8:
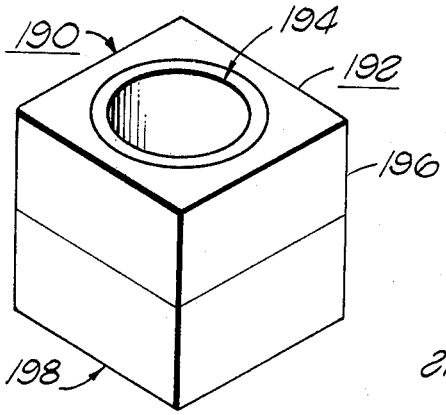
FIG. 8 is a perspective view of another embodiment of the present invention.

FIG. 8 illustrates an embodiment generally designated 190, in which a body means 192 is provided, having a female interblock coupling means 194 therein. The female interblock coupling means may be generally similar to the female interblock coupling means 48 and 128 described above. However, as shown on FIG. 8, no internal ridges, and no slots are provided in the female interblock coupling means 194. The body means 192 is comprised of the first body member 196 and second body member 198, which may be coupled together by any of the coupling means described above. In embodiment 190, however, no male interblock coupling means are provided.

Figure 9:
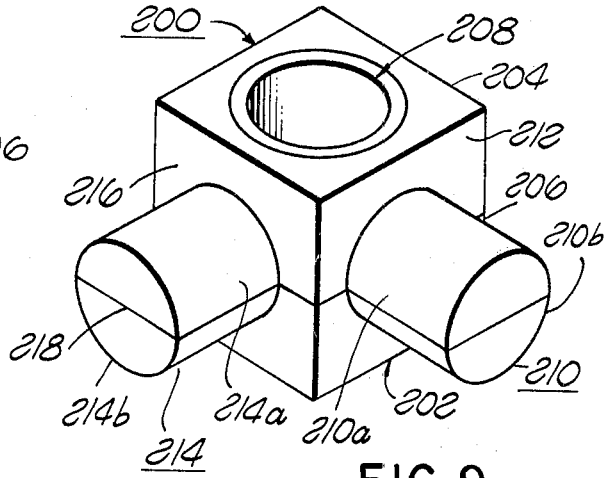
FIG. 9 is a perspective view of another embodiment of the present invention.

FIG. 9 illustrates another embodiment of the present invention, generally designated 200. In the embodiment 200, there is provided a body means 202, comprised of a first body member 204 coupled to a second body member 206. The coupling means utilized to interconnect first body member 204 with second body member 206 may be any of the coupling means described above. The female interblock coupling means 208, which may be similar to the female interblock coupling means 194, described above, or, if desired, similar to the female interblock coupling means 48 and 128 described above, is also provided in the body means 202. In the embodiment 200, there are provided a first male interblock coupling means 210, extending outwardly a predetermined distance from a wall member 212 of the body means 202 and a second male interblock coupling means 214, extending outwardly a predetermined distance from a second wall member 216 of body means 202. In the embodiment 200, the first male interblock coupling means 210 extends outwardly in a direction substantially perpendicular to the direction in which second male interblock coupling means 214 extends. As described above in connection with embodiment 10, each of the first male interblock coupling means 210 and second male interblock coupling means 214 are divided by the median plane 218 into first male member 210a on first body member 212 and second male member 210b on second body member 206. Similarly, second male interblock coupling means 214 is divided by the median plane 218 into a first male member 218*a* on first body member 204 and second male member 218*b* on second body member 206.

Figure 10:
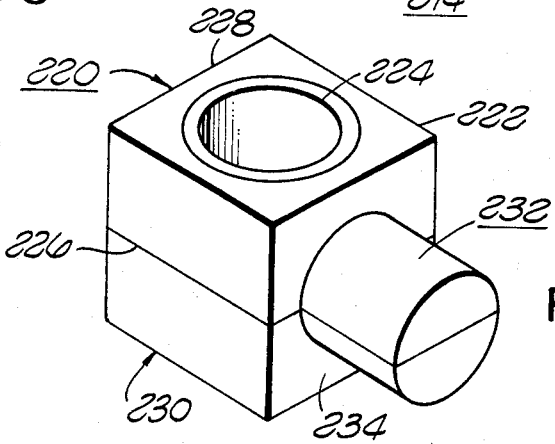
FIG. 10 is a perspective view of another embodiment of the present invention.

FIG. 10 illustrates another embodiment of the present invention, generally designated 220, in which there is provided a body means 222, which is provided with a female interblock coupling means 224, which may be generally similar to any of the female interblock coupling means described above. In the embodiment 220, the body means 222 is divided by median plane 226 into a first body member 228 and a second body member 230. The first body member 228 and the second body member 230 may be coupled together by any of the coupling means described above. In the embodiment 220, only one male interblock coupling means 232 is provided and it extends outwardly a predetermined distance from wall member 234 of body means 222.

Figure 11:
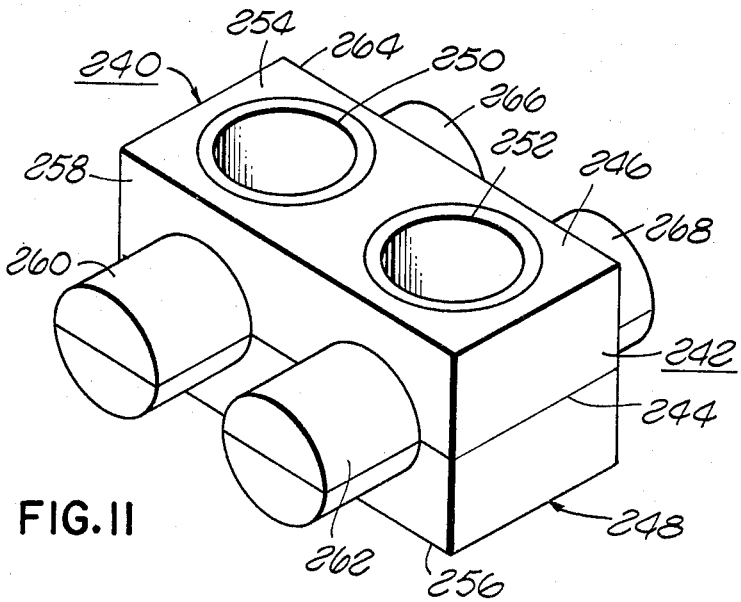
FIG. 11 is a perspective view of another embodiment of the present invention.

FIG. 11 illustrates another embodiment of the present invention, generally designated 240, comprised of a body means 242 divided by a median plane 244 into a first body member 246 and a second body member 248, coupled together by any of the above described coupling means along the median plane 244. Body means 242 in the embodiment 240 is provided with two female interblock coupling means 250 and 252, which may be similar to the female interblock coupling means described above. They are positioned in spaced apart relationship and extend through body means 242 from wall member 254 to 256. Wall member 258 of body means 242 is provided with two male interblock coupling means 260 and 262 extending outwardly a predetermined distance from the wall member 258 and may be generally similar to any of the male interblock coupling means described above. Wall member 264 of body means 242 is also provided, in embodiment 240, with a pair of spaced apart male interblock coupling means 266 and 268, which may be similar to the pair of spaced apart interblock coupling means 260 and 262.

Many other variations of configurations of toy blocks according to the principles of the present invention may be made. Thus, according to the principles of the present invention, each toy block arrangement is provided with at least one female interblock coupling means. The toy blocks of any one set may be provided with no male interblock coupling means, one, two, three, four, or more male interblock coupling means, and, for each such set, the male interblock coupling means are frictionally and detachably mountable in the female interblock coupling means. Further, the body means of each toy block, according to the principle of the present invention, is comprised of two separate body members, coupled together along a median plane which also divides the male interblock coupling means, if such be provided on the particular block, into two male members, one forming a part of each of the body members.

This concludes the description of the present invention. Those skilled in the art may find many variations and adaptations of the present invention, and all such variations and adaptations falling within the true scope and spirit of the present invention are intended to be covered by the appended claims.

What is claimed is:

1. A toy block arrangement comprising, in combination:

a semi-rigid body means having a first predetermined flexibility and having a plurality of wall members, and each of said plurality of wall members having inner surfaces and outer surfaces, and said inner surfaces thereof defining a body cavity, and said body means comprising:

a first body member having a first group of said plurality of wall members; and a second body member having a second group of said plurality of wall members; and said first body member coupled to said second body member along a median plane and each of said first and second body members having peripheral edge surfaces at said median plane;

coupling means on said first body member and said second body member for coupling said first body member to said second body member along said median plane;

a first wall of said first group of said plurality of wall members of said first body member of said body means having first internal walls defining a first aperture therethrough;

a second wall of said second group of said plurality of wall members of said second body member of said body means having second internal walls defining a second aperture therethrough aligned with said first aperture;

a first semi-rigid female interblock coupler means discrete from said semi-rigid body means comprising a first female coupler member and a second female coupler member, and each of said first and second female coupler members having:

an outer end;

an inner end spaced a preselected distance from said outer end, and said inner end positioned in said body cavity of said body means;

walls extending from said outer end to said inner end and said walls having external surfaces and internal surfaces, said internal surfaces defining a male coupler receiving aperture extending from said outer end toward said inner end; and interconnection means on said inner ends of said first and second female coupler members for interconnecting said first female coupler member to said second female coupler member, and said first female coupler member positionable in said first aperture of said first body member of said body means and said second female coupler member positionable in aid second aperture in said second body member of said body means whereupon said first female coupler member and said second female coupler member are coupled together by said interconnection means thereon; and retention means for retaining said outer end of said first female coupler member at said first wall of said first body member and said outer end of said second female coupler member at said second wall of said second body member.

2. The arrangement defined in claim 1, wherein:

said coupling means for coupling said first body member to said second body member further comprises:

a plurality of male body coupling members extending outwardly from said peripheral edge surface of said first body member;

walls on said peripheral edge surface of said second body member defining a plurality of male body coupling member receiving cavities therein; and said plurality of male body coupling members positionable in said male body coupling member receiving cavities and frictionally retainable therein to couple said first body member to said second body member.

3. The arrangement defined in claim 2, wherein:

said male body coupling members further comprise:

a shaft portion; and a headed portion coupled to said shaft portion and spaced from said peripheral edge surface, and said headed portion having a greater dimension than said shaft portion.

4. The arrangement defined in claim 1, wherein:

one of said first internal walls of said first body member and said second internal walls of said second body member further comprises:

skirt means extending a predetermined distance into said body cavity.

5. The arrangement defined in claim 4, wherein:

said skirt means extends beyond said median plane.

6. The arrangement defined in claim 1, wherein:

said first internal walls of said first body member further comprises a first skirt means extending into said body cavity to said median plane; and said second internal walls of said second body member comprises a second skirt means extending into said body cavity to said median plane; and said first skirt means and said second skirt means in abutment at said median plane.

7. The arrangement defined in claim 1, wherein:

said internal surfaces of said walls of said first and said second female coupler members have a plurality of internal ridges thereon extending from regions adjacent said outer ends toward said inner ends.

8. The arrangement defined in claim 7, wherein:

said internal ridges extend to said inner end.

9. The arrangement defined in claim 1, wherein:

said retention means further comprises:

said external surfaces of said walls of each of said first and said second female coupler members have a plurality of external ridges thereon extending from said outer end a predetermined distance toward said inner end, and said plurality of external ridges on said external surfaces of said walls of said first female coupler member frictionally engages said first internal walls of said first body member, and said plurality of external ridges on said external surface of said walls of said second female coupler member frictionally engages said second internal walls of said second body member.

10. The arrangement defined in claim 1, wherein:

said internal surfaces of said walls of said first and said second female coupler members have a plurality of internal ridges thereon extending from regions adjacent said outer ends toward said inner ends.

11. The arrangement defined in claim 10, wherein:

one of said first internal walls of said first body member and said second internal walls of said second body member further comprises:

skirt means extending a predetermined distance into said body cavity, and said skirt means frictionally engaging said external ridges.

12. The arrangement defined in claim 11, wherein:

said skirt means extends beyond said median plane.

13. The arrangement defined in claim 9, wherein:

said first internal walls of said first body member further comprises a first skirt means extending into said body cavity to said median plane; and said second internal walls of said second body member comprises a second skirt means extending into said body cavity through said median plane; and said first skirt means and said second skirt means in abutment at said median plane, and said external ridges on said first female coupler member frictionally engages said first skirt means and said external ridges on said second female coupler member frictionally engages said second skirt means.

14. The arrangement defined in claim 1, and further comprising:

a third wall member of said plurality of wall members of said body means further comprises a first male interblock coupler means frictionally and detachably retainable in a female coupler means of another toy block.

15. The arrangement defined in claim 14, wherein:

said first male interblock coupler means is divided by said median plane and comprises a first male member on said first body member of said body means and a second male member on said second body member of said body means;

said coupling means further comprises:

a plurality of male body coupling members extending outwardly from said peripheral edge surface of said first body member;

walls on said peripheral edge surface of said second body member defining a plurality of male body coupling member receiving cavities therein; and said plurality of male body coupling members positionable in said male body coupling member receiving cavities and frictionally retainable therein to couple said first body member to said second body member;

a first headed male member coupled to said first male member of said first male interblock coupler means and extending into said body cavity; and walls defining an aperture in said second male member of said male interblock coupler means communicating with said body cavity for retaining said first headed male member therein.

16. The arrangement defined in claim 14, further comprising:

a fourth wall member of said plurality of wall members of said body means further comprises a second male interblock coupler means frictionally and detachably retainable in a female interblock coupler means of another toy block.

17. The arrangement defined in claim 16, wherein:

each of said first and second male interblock coupler means is divided by said median plane and comprises a first male member on said first body member of said body means and a second male member on said second body member of said body means;

a first headed male member on said first male member of said first male interblock coupler means extending into said body cavity;

walls on said second male member of said first male interblock coupler means defining a headed male member receiving aperture communicating with said body cavity for retaining said first headed male member therein;

a second headed male member on said second male member of said second male interblock coupler means and extending into said body cavity;

walls in said first male member of said second male interblock coupler means defining a second headed male member receiving aperture communicating with said body cavity for retaining said second headed male member therein.

18. The arrangement defined in claim 16, wherein:

said second male interblock coupler means is aligned with said first male interblock coupler means.

19. The arrangement defined in claim 16, wherein:

said second male interblock coupler means extends substantially at right angles to said first male interblock coupler means.

20. The arrangement defined in claim 14, and further comprising:

said third wall member of said plurality of wall members of said body means further comprises a third male interblock coupler means frictionally and detachably retainable in a female interblock coupler means of another toy block.

21. The arrangement defined in claim 14, wherein:

said third wall member of said plurality of wall members of said body means further comprises a third male interblock coupler means frictionally and detachably retainable in a female interblock coupler means of another toy block, and said fourth wall member of said plurality of wall members of said body means further comprises a fourth male interblock coupler means aligned with said third male interblock coupler means, and said fourth male interblock coupler means frictionally and detachably retainable in a female interblock coupler means of another toy block.

22. The arrangement defined in claim 21 and further comprising:

said first wall of said first group of said plurality of wall members of said first body member of said body means having third internal walls defining a third aperture therethrough;

said second wall of said second group of said plurality of wall members of said second body member of said body means having fourth internal walls defining a fourth aperture therethrough aligned with said third aperture;

a second semi-rigid female interblock coupler means comprising a first female coupler member and a second female coupler member substantially identical to said first semi-rigid female interblock coupler means, in said third and fourth apertures.

* * * * *